US005228153A

United States Patent [19]

Frankel

[11] Patent Number: 5,228,153

[45] Date of Patent: Jul. 20, 1993

[54] PROTECTIVE COVER FOR A DRAIN HANDLE FIXTURE

[75] Inventor: Gail B. Frankel, Dallas, Tex.

[73] Assignee: Kel-Gar, Inc., Dallas, Tex.

[21] Appl. No.: 773,355

[22] Filed: Oct. 8, 1991

[51] Int. Cl.[5] ..... E03C 1/244

[52] U.S. Cl. ..... 4/694

[58] Field of Search ..... 4/661, DIG. 18, DIG. 14, 4/286, 287, 289, 292, 293, 559, 198, 201, 204, 206, 208, 680–682, 694, 255.01, 255.07, 686, 654; 138/96 R; 217/114; 150/156

[56] References Cited

U.S. PATENT DOCUMENTS

| | | | |
|---|---|---|---|
| D. 282,563 | 2/1986 | Beene | D23/36 |
| 1,598,162 | 8/1926 | Solomon | 4/694 |
| 3,221,347 | 12/1965 | Emery | 4/694 |
| 3,392,844 | 7/1968 | Decarie | 4/292 X |
| 3,497,878 | 3/1970 | Emery | 4/206 |
| 3,927,428 | 12/1975 | Jette et al. | 4/694 |
| 4,134,162 | 1/1979 | Sharland et al. | 4/292 |
| 4,353,139 | 10/1982 | Wainwright et al. | 4/661 |
| 4,446,583 | 5/1984 | Dean | 4/661 |

FOREIGN PATENT DOCUMENTS

| | | | |
|---|---|---|---|
| 2641595 | 7/1990 | France | 4/293 |
| 0624483 | 7/1981 | Switzerland | 4/661 |

*Primary Examiner*—Charles E. Phillips

*Attorney, Agent, or Firm*—Konneker, Bush & Hitt

[57] ABSTRACT

A protective cover for a drain handle fixture. The protective cover includes a semi-spherical central section having a peripheral edge and a ring shaped outer section integral formed with the peripheral edge and removably mounted to a front interior wall of a bathtub such that the semi-spherical central section protectively covers a drain handle fixture mounted to the front interior wall. The semi-spherical central section is provided with at least one aperture formed therein, thereby permitting the actuation of a drain handle projectingly mounted to the drain handle fixture. Preferably, the semi-spherical section is sized with respect to the drain handle to selectively limit access to the drain handle through the apertures.

6 Claims, 3 Drawing Sheets

PROTECTIVE COVER FOR A DRAIN HANDLE FIXTURE

CROSS REFERENCE TO RELATED APPLICATION

This application is related to co-pending U.S. patent application Ser. No. 07/735,366 of Gail B. Frankel entitled PROTECTIVE COVER FOR A DRAIN HANDLE, filed Jul. 24, 1991 and assigned to the assignee of the present invention.

BACKGROUND OF THE INVENTION

Field of the Invention

This invention is related to protective covers for water fixtures and more particularly, to a protective cover for a drain handle fixture configured to further permit the normal operation thereof.

DESCRIPTION OF RELATED ART

Water fixtures such as those utilized to control the ejection of water into a bathtub have traditionally been constructed out of brass, steel and other hard, non-deformable materials. As a result, there has always been a significant risk of serious injury in the event that a person slips or otherwise loses their balance and strikes the water fixture with any degree of force. Infants and young children, notoriously well known for frequent injury related accidents, are particularly at risk for injuries of this type. For example, sudden movement by a young child, either bathing alone or under supervision of a parent, could result in the child striking his or her head against the water fixture, thereby resulting in a potentially serious head injury.

As a result, various protective covers for individual water fixtures have been disclosed in the art. For example, U.S. Pat. No. 4,353,139 to Wainwright et al. discloses a longitudinally extending protective cover for a bathtub spout. The protective cover disclosed by Wainwright et al. is formed from a soft, deformable, cushioning material. Similarly, Nos. Des. 326,312, 5,125,577, and Des. 326,313 disclose additional configurations of a longitudinally extending protective cover for a bathtub spout. In all of these references, the protective cover has been provided with an aperture at the lower end of its longitudinal extension for the ejection of water therefrom. However, as the exclusive function of the bathtub spout is the ejection of water therefrom, such protective covers have not provided for the operation of control elements attached to the protectively covered spout.

Wainwright et al. further discloses the use of the disclosed bathtub spout with other water fixtures, including the hot water handle and cold water handle for a bathtub by cuffing the protective cover when mounting it to the relatively shorter hot or cold water handles. Unlike the limited purpose of the bathtub spout, the water handle controls the ejection of water from a water spout associated therewith. Accordingly, it may be necessary to perform certain control functions when the handle is protectively covered. In this regard, Wainwright et al. is silent.

SUMMARY OF THE INVENTION

The present invention is of a protective cover for a drain handle fixture which comprises a semi-spherical central section having a peripheral edge, a ring shaped outer section circumferentially mounted to the peripheral edge and means for removably mounting the ring shaped outer section to a front interior wall of a bathtub such that the semi-spherical central section protectively covers a drain handle fixture mounted to the front interior wall. In one aspect of the invention, the semi-spherical central section is provided with at least one aperture formed therein, thereby permitting the actuation of a drain handle projectingly mounted to the drain handle fixture. Preferably, the semi-spherical section is sized with respect to the drain handle to selectively limit access to the drain handle through the apertures.

BRIEF DESCRIPTION OF THE DRAWINGS

The present invention may be better understood, and its numerous objects, features and advantages will become apparent to those skilled in the art by reference to the accompanying drawings in which.

DETAILED DESCRIPTION OF A PREFERRED EMBODIMENT

Figure 1:
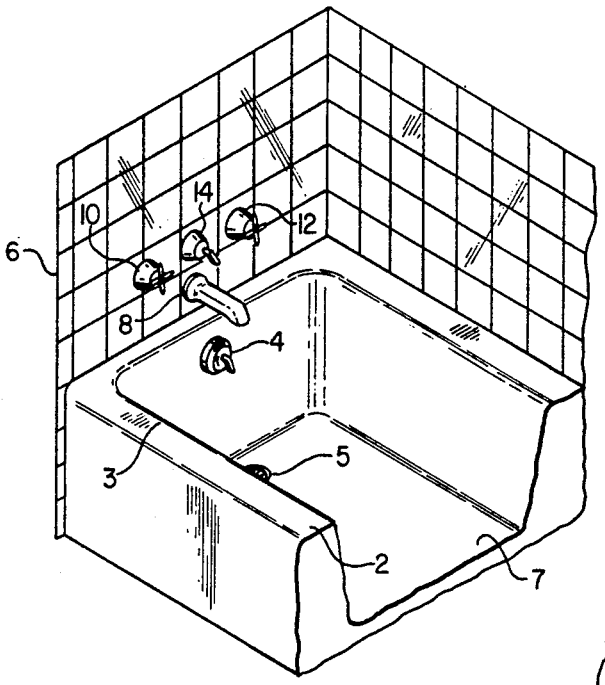
FIG. 1 (PRIOR ART)
FIG. 1 is a perspective view of a bathtub having various water fixtures, including a drain handle fixture, associated therewith.

Referring first to FIG. 1, a bathtub 2 of conventional design may now be seen. As is also common in the art, a drain handle fixture 4 is fixedly mounted along a front interior wall 3 of the bathtub 2. As will be more fully described below, the drain handle fixture 4 includes a base structure have an overflow drain formed therein and a handle rotatably mounted to the base structure for opening and closing a drain 5 provided along an interior base wall 7 of the bathtub 2 by mechanical linkage means not visible in FIG. 1. The bathtub 2 is positioned against a tiled wall 6 from which a spout or other water ejection fixture 8 protrudes therefrom. Also protruding from the wall 6 are hot and cold water fixtures 10, 12, which control the amount of hot and/or cold water, respectively, to be ejected from the spout 8, and a shower control 14 which controls the operation of a shower head (not shown) by alternately selecting the spout 8 or the shower head for the ejection of water therefrom.

Figure 2:
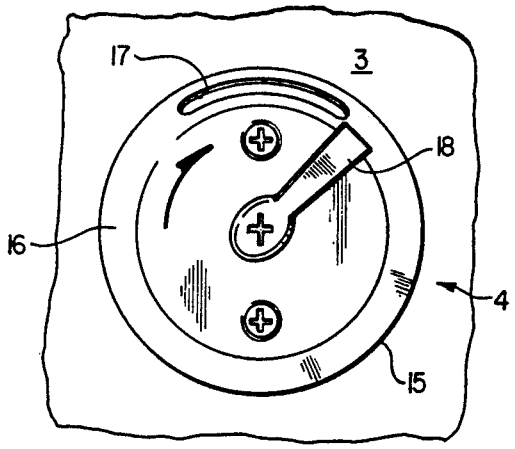
FIG. 2 (PRIOR ART)
FIG. 2 is a front view of the drain handle fixture of FIG. 1.

Referring next to FIG. 2, the drain handle fixture 4 may now be seen in greater detail. The drain handle fixture 4 includes a base structure 15 and a generally cylindrical body section 16 projecting therefrom. The cylindrical body section 16 is provided with an overflow drain 17 formed, preferably along the top of the body section 16, therein for draining excess water from the bathtub 2 when the water level exceeds the overflow drain 17. Outwardly projecting from the body section 16 is a drain handle 18 rotatable along its axis to control the opening and closing of the bathtub drain 5. The diameter of the base structure 15 of the drain handle fixture 4 herein described is approximately 4 ½ inches. It is contemplated, however, that the protective cover described and illustrated herein may be utilized to protectively over drain handle fixture of various configurations and/or dimensions without substantially departing from the teachings of the present invention.

Figure 3:
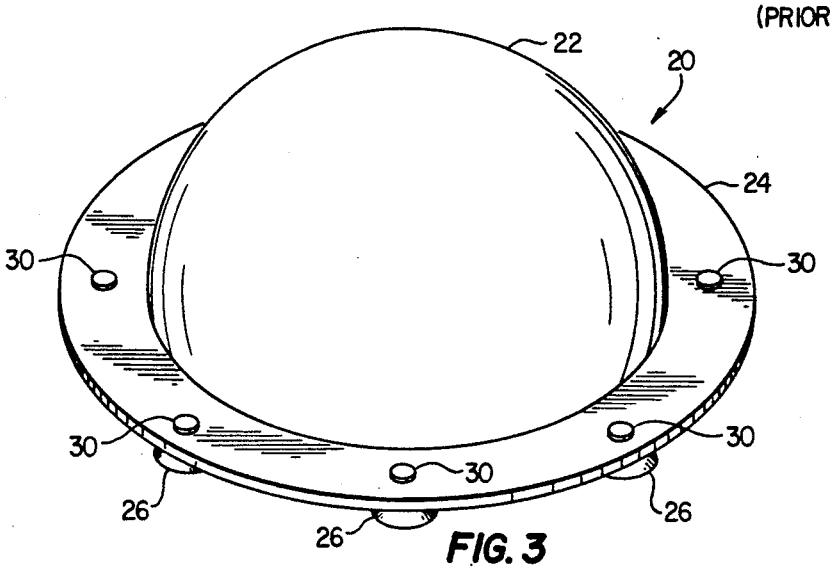
FIG. 3 is a perspective view of a first embodiment of a protective cover for a drain handle fixture which is constructed in accordance with the teachings of the present invention.
Figure 4:
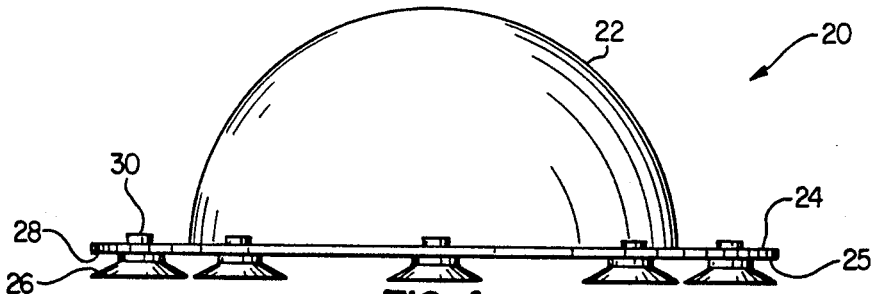
FIG. 4 is a side view of the protective cover for a drain handle fixture illustrated in FIG. 3.

Referring next to FIG. 3, a protective cover 20 for a drain handle fixture constructed in accordance with the teachings of the present invention may now be seen. The protective cover 20 includes a generally semi-spherical central section 22 integrally formed with a generally flattened ring section 24 circumferentially extending along the outer perimeter of the semi-spherical central section. As will be more fully described below, the ring section 24 removable mounts the protective cover 20 to the front interior wall 3 of the bathtub 2 such that the semi-spherical central section 22 protectively covers the drain handle fixture 4. More specifically, the protective cover 20 is removably mounted to the front interior wall 3 of the bathtub 2 by a plurality of suction members 26 mounted to a bottom side 25 of the ring section 24. In the embodiment disclosed herein, it is contemplated that eight (8) suction members 26 will satisfactorily mount the protective cover 20 to the front interior wall 3 of the bathtub 2 although it is expected that varying numbers of suction members may be utilized to removably mount the protective cover 20 in a satisfactory manner. Each suction member 26 includes a shaft, preferably formed of a flexible rubber-like material, having a first widened section 28 below the ring section 24, a narrowed section (not visible in FIG. 4) which extends through a corresponding aperture 31 in the ring section 24 and a second widened section 30 positioned above the ring section 24. To mount the suction members 26 to the ring section 24, the second widened section 30 is inserted through the corresponding aperture 31 to secure the suction members 26 to the ring section 24 in a snap-fit.

Figure 5:
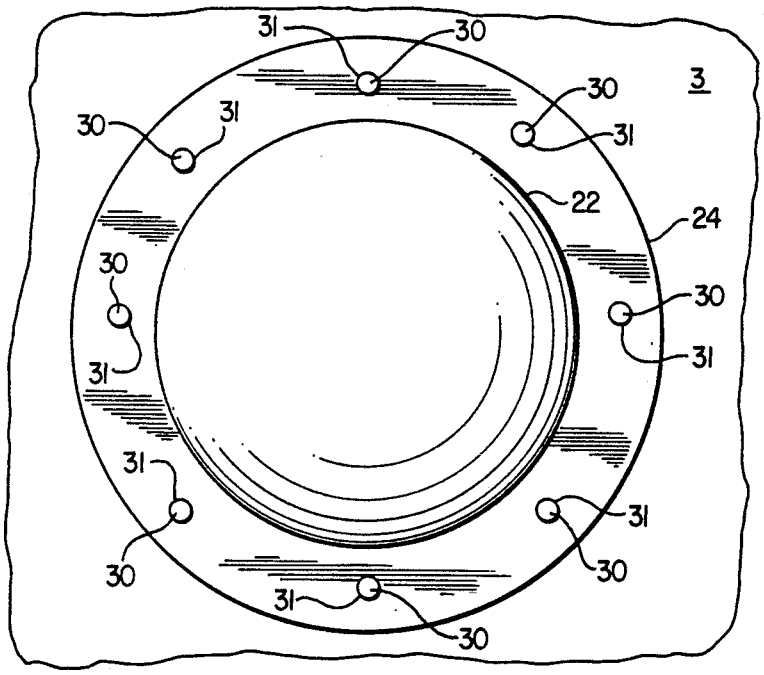
FIG. 5 is a front view of the protective cover for a drain handle fixture illustrated in FIGS. 3–4 mounted to protectively cover a drain handle fixture.

Referring next to FIG. 5, the protective cover 20 mounted to the front interior wall 3 of the bathtub 2 such that the drain handle fixture 4 is protectively covered thereby may now be seen. Once mounted, a child accidently slipping in the direction of the drain handle fixture 4 will strike the protective cover 20, preferably formed of a relatively soft, deformable material, instead, thereby avoiding the possibility of serious injury to the child.

Figure 6:
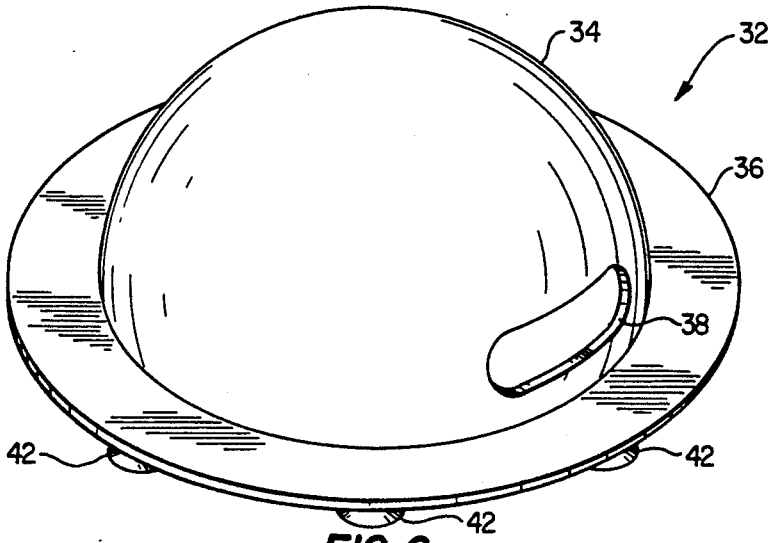
FIG. 6 is a perspective view of a second embodiment of a protective cover for a drain handle fixture which is constructed in accordance with the teachings of the present invention.

Referring next to FIG. 6, a second, preferred, embodiment of a protective cover for a drain handle fixture may now be seen. As before, the protective cover 32 includes a semi-spherical section 34 and a ring-like section 36. In this embodiment of the invention, however, at least one generally oblong-shaped aperture 38 is formed in the semi-spherical section 34. While the diameter of the semi-spherical section 34 may be varied without departing from the teachings of the present invention, it is contemplated that, for a drain handle fixture having a diameter of approximately 4 ½ inches, the semi-spherical section 34 may have a diameter of at least 5 ¼ to 5 ½ and inches.

Figure 7:
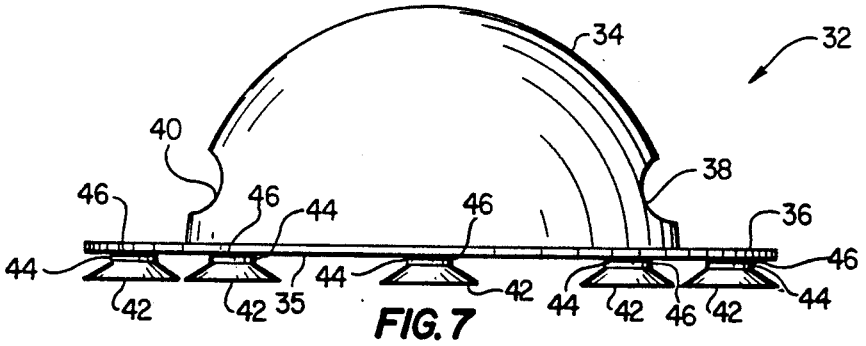
FIG. 7 is a side view of the protective cover for a drain handle fixture illustrated in FIG. 6.

Referring next to FIG. 7, yet another embodiment of a protective cover for a drain handle fixture may be seen. In this embodiment, first and second oblong aperture 38, 40 positioned approximately 180 degrees apart are formed in the semi-spherical section 34. As may also be seen with respect to FIG. 7, a plurality of suction members 42 are fixedly secured to a bottom side 35 of the ring-like section 36 for securing the protective cover 32 to the front interior wall 3 of the bathtub 2. In this embodiment, however, each suction member 42 includes a shaft 44 fixedly secured to the bottom side 35 of the ring-like section 36 by a layer 46 of an adhesive material.

Figure 8:
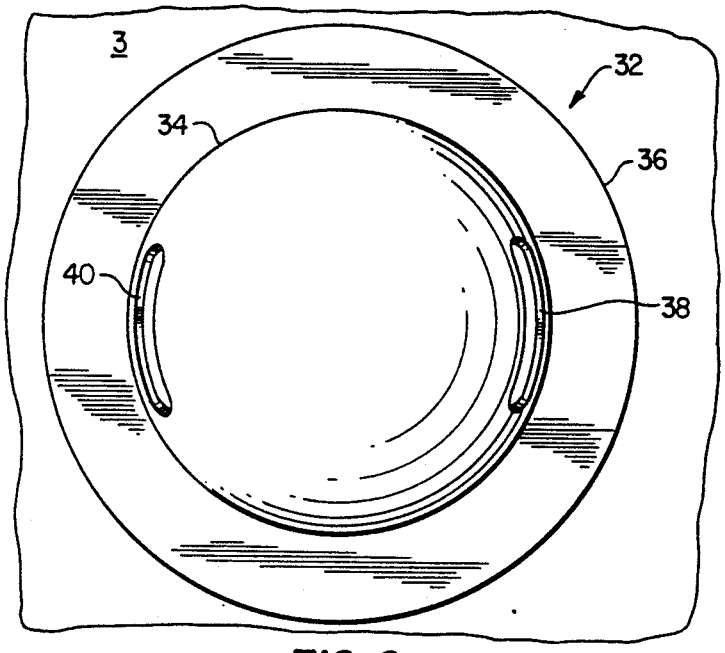
FIG. 8 is a front view of the protective cover for a drain handle fixture illustrated in FIGS. 6–7 mounted in a first arrangement to protectively cover a drain handle fixture.

Referring next to FIG. 8, the protective cover 34 mounted to the front interior wall 3 of the bathtub 2 in a first arrangement such that the drain handle fixture 4 is protectively covered thereby may now be seen. In this embodiment, the purposes of the apertures 38, 40 may now be clearly seen. As previously discussed, the drain handle fixture 4 includes a drain handle 18 which must be manually rotated to open and/or close the drain 5. Thus, once mounted to the front interior wall 3 of the bathtub 2, the protective cover 20 must be removed in order to manipulate the drain handle 18. The same is not true for the protective cover 32. Here, the apertures 38, 40 permit access to the drain handle 18 while the protective cover 32 remains mounted to the front interior wall 3. Thus, the bathtub 2 may be drained or prepared for filling while the protective cover 32 remains in place. It is further contemplated that the protective cover 32 be sized to prevent access to the drain handle 18 by infants and/or small children. For example, the semi-spherical section 34 described herein is about 5 ¼ to 5 ½ inches in diameter. If the drain handle 18, on the other hand, is approximately one inch in length, the drain handle 18 will be more than 1 ½ inches from the apertures 38, 40, a distance which places the drain handle 18 out of the reach of most infants and/or small children in the event that they insert their fingers into the apertures 38, 40. In this manner, infants and/or small children are prevented from actuating the drain 5. On the other hand, an adult may readily control the operation of the drain 5 by inserting their fingers into the apertures 38, 40 and manipulating the drain handle 18. As will become readily apparent, the distance between the apertures 38, 40 and the drain handle 18 may be varied depending on the dimensions of the drain handle 18, the drain handle fixture 4 and the semi-spherical section 34. It should be clearly understood, however, that, when varying these dimensions of these elements, it is preferred that the dimensions be selected such that the distance between the apertures 38, 40 and the drain handle 18 should be at least one half inch when it is desired to exclude infants and/or small children having fingers less than one half inch in length, one inch when it is desired to exclude infants and/or small children having fingers less than one inch in length, one and one half inches when it is desired to exclude infants and/or small children having fingers less than one and one half inches in length, two inches when it is desired to exclude infants and/or small children having fingers less than two inches in length and two and one half inches when it is desired to exclude infants and/or small children having fingers less than two and one half inches in length.

Figure 9:
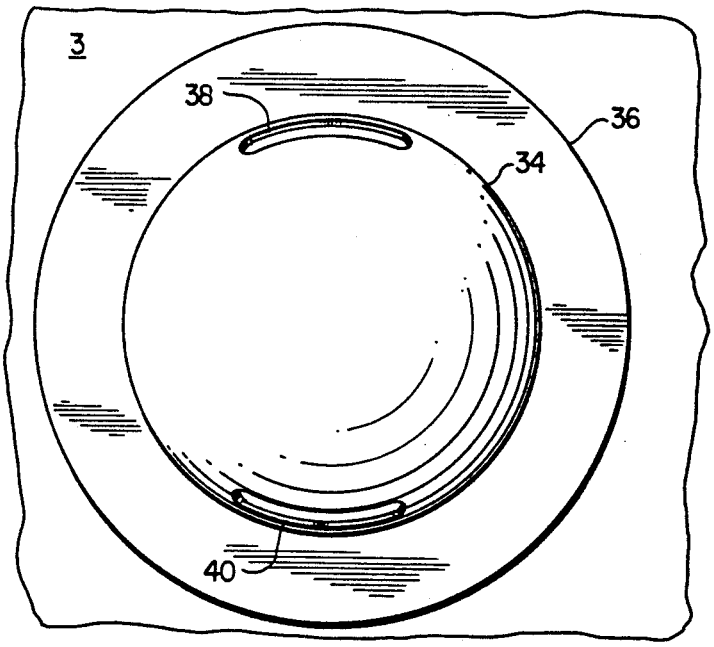
FIG. 9 is a front view of the protective cover for a drain handle fixture illustrated in FIGS. 6–7 mounted in a second arrangement to protectively cover a drain handle fixture.

The apertures 38, 40 also prevent the protective cover 32 from blocking or slowing operation of the overflow drain 17. While it is expected that there will be a small space between the bottom side 35 of the ring-like section 36 and the front interior wall 3 when the protective cover 34 is mounted thereto, the apertures 38, 40 ensure that, in the event of an excess water level in the bathtub 2, the draining of excess water via the overflow drain 17 will remain unimpeded. Finally, it should be noted that FIG. 8 illustrates the protective cover 32 mounted to the front interior wall 3 in a first arrangement such that the apertures 38, 40 are horizontally positioned with respect to the outer circumferential edge of the drain handle fixture 4 while FIG. 9 illustrates the protective cover 32 mounted to the front interior wall 3 in a second arrangement such that the apertures 38, 40 are vertically positioned with respect to the outer circumferential edge of the drain handle fixture 4. The alternate arrangements illustrated in FIGS. 8 and 9, with either one or both of the apertures 38, 40 present, may be preferred depending on the particular design of the drain handle fixture 4. For example, it may be easier to actuate a drain handle fixture having a drain handle displaceable between left and right positions when the apertures 38 and/or 40 are positioned in the first arrangement while it may be easier to actuate a drain handle fixture having a drain handle displaceable between up and down positions when the apertures 38 and/or 40 are positioned in the second arrangement.

Thus, there has been described and illustrated herein a protective cover for a drain handle fixture which fully covers the protruding drain handle fixture and drain handle associated therewith, thereby cushioning the impact of an accidental strike against the drain handle fixture and which further includes at least one aperture which permit limited access to the drain handle associated with the drain handle fixture as well as prevents interference with the overflow drain function of the drain handle fixture. Those skilled in the art, however, will recognize that many modifications and variations besides those specifically mentioned may be made in the techniques described herein without departing substantially from the concept of the present invention. Accordingly, it should be clearly understood that the form of the invention as described herein is exemplary only and is not intended as a limitation of the scope of the invention.

What is claimed is:

1. A protective cover for a drain handle fixture mounted to a front interior wall of a bathtub, said drain handle fixture having a base and a drain handle mounted to said base and outwardly projecting therefrom a specified distance in a first direction, said drain handle operatively connected to a drain for said bathtub, comprising:

a semi-spherical central section having a radius of at least one and one-half inches greater than said specified distance, said semi-spherical central section formed from a soft, deformable material and having a peripheral edge;

a ring shaped outer section circumferentially mounted to said peripheral edge and having a bottom side; and means for removably mounting said ring shaped outer section to a front interior wall of a bathtub;

wherein said semi-spherical central section protectively covers said drain handle fixture and wherein said semi-spherical central section has exactly two restrictive access apertures formed therein for providing digital access to said drain handle for the actuation thereof of said drain operatively connected with said drain handle by persons having at least one digit longer than one and one-half inches.

2. A protective cover for a drain handle fixture according to claim 1 wherein said means for removably mounting said ring shaped outer section to a front interior wall of a bathtub further comprises at least one suction member fixedly secured to said bottom side of said ring shaped outer section.

3. A protective cover for a drain handle fixture according to claim 2 wherein each of said at least one suction member is adhesively mounted to said bottom side of said ring shaped outer section.

4. A protective cover for a drain handle fixture mounted to a front interior wall of a bathtub, said drain handle fixture having a base and a drain handle mounted to said base and outwardly projecting therefrom a specified distance in a first direction, said drain handle operatively connected to a drain for said bathtub, comprising:

a semi-spherical central section having a radius of at least one and one-half inches greater than said specified distance, said semi-spherical section formed from a soft, deformable material and having a peripheral edge;

a ring shaped outer section circumferentially mounted to said peripheral edge and having a bottom side; and means for removably mounting said ring shaped outer section to a front interior wall of a bathtub;

said semi-spherical central section protectively covering said drain handle fixture;

wherein said semi-spherical central section has exactly two restrictive access apertures spaced approximately 180 degrees apart along the surface thereof formed therein for providing digital access to said drain handle for the actuation thereof of said drain operatively connected with said drain handle by persons having at least one digit longer than one and one-half inches.

5. A protective cover for a drain handle fixture according to claim 4 wherein said means for removably mounting said ring shaped outer section to a front interior wall of a bathtub further comprises at least one suction member fixedly secured to said bottom side of said ring shaped outer section.

6. A protective cover for a drain handle fixture according to claim 5 wherein each of said at least one suction member is adhesively mounted to said bottom side of said ring shaped outer section.

* * * * *